US012644617B2

(12) United States Patent
Carlay, II et al.

(10) Patent No.: US 12,644,617 B2
(45) Date of Patent: Jun. 2, 2026

(54) MOISTURE AND/OR THERMAL RESISTANCE MONITORING SYSTEM FOR INSULATION-CONTAINING CONDUIT AND METHODS OF USE

(71) Applicant: FLEXIBLE TECHNOLOGIES, INC., Abbeville, SC (US)

(72) Inventors: Ronald L. Carlay, II, Laurens, SC (US); Andrew Kim, Fremont, CA (US); Hunter Farr, Aiken, SC (US)

(73) Assignee: ROYAL METAL PRODUCTS, Temple, GA (US)

( * ) Notice: Subject to any disclaimer, the term of this patent is extended or adjusted under 35 U.S.C. 154(b) by 788 days.

(21) Appl. No.: 17/885,624

(22) PCT Filed: Feb. 12, 2021

(86) PCT No.: PCT/US2021/017837

§ 371 (c)(1),
(2) Date: Aug. 11, 2022

(87) PCT Pub. No.: WO2021/163465

PCT Pub. Date: Aug. 19, 2021

(65) Prior Publication Data

US 2024/0191893 A1 Jun. 13, 2024

Related U.S. Application Data

(60) Provisional application No. 62/975,840, filed on Feb. 13, 2020.

(51) Int. Cl.
*F24F 11/30* (2018.01)
*F24F 11/88* (2018.01)
(Continued)

(52) U.S. Cl.
CPC ..... *F24F 11/30* (2018.01); *F24F 11/88* (2018.01); *F24F 13/0263* (2013.01); *F24F 13/0281* (2013.01); *F24F 2110/20* (2018.01)

(58) Field of Classification Search
CPC ..... F24F 13/0218; F24F 13/0263; F24F 13/0281; F24F 11/30; F24F 11/88;
(Continued)

(56) References Cited

U.S. PATENT DOCUMENTS 3,796,977 A 3/1974 Elliott et al.
4,673,652 A 6/1987 McStravick et al.
(Continued)

*Primary Examiner* — Huy Q Phan
*Assistant Examiner* — David B Frederiksen
(74) *Attorney, Agent, or Firm* — Millen, White, Zelano & Branigan, P.C.; Christopher W. Brody

(57) ABSTRACT

A flexible or rigid fluid-carrying conduit system has an inner conduit, an outer member, and a space between the inner conduit and outer member, the space including an insulator. Each of the outer surface of the inner conduit and the inner surface of the outer member is electrically conductive. These electrically conductive surfaces are used for detection of moisture in the fluid-carrying conduit by providing either an electrical circuit or a capacitance measuring device. Completion of the electrical circuit provides an indication that moisture has entered the space between the inner conduit and outer member so that remedial action can be taken. Measuring the capacitance between the inner conduit and the outer member also allows for monitoring moisture in this space. The capacitance measuring function can also be used to monitor changes in thermal resistance of the conduit. The fluid-carrying conduit have a liner, bulk insulation, and a vapor barrier.

35 Claims, 9 Drawing Sheets

(51) Int. Cl.
*F24F 13/02* (2006.01)
*F24F 110/20* (2018.01)

(58) Field of Classification Search
CPC ..... F24F 11/89; F16L 59/14; G01M 3/04; G01M 3/042; G01M 3/045; G01M 3/16; G01M 3/18–188
See application file for complete search history.

(56) References Cited

U.S. PATENT DOCUMENTS 4,922,232 A * 5/1990 Bosich ..... G01M 3/045 200/61.04
7,292,155 B2 * 11/2007 Vokey ..... G01M 3/045 340/602
8,667,995 B1 * 3/2014 Fanelli ..... F24F 13/0245 138/112
10,295,218 B2 5/2019 Campbell et al.
2006/0244616 A1 * 11/2006 Hill ..... G01M 3/045 359/512
2008/0053198 A1 * 3/2008 Issel ..... F16L 11/12 73/40.5 R
2009/0139178 A1 * 6/2009 Vokey ..... G01M 3/16 52/749.12
2010/0096021 A1 * 4/2010 Keyes ..... F16L 59/15 137/15.01
2010/0186846 A1 * 7/2010 Carlay, II ..... F24F 13/0218 29/700
2012/0010845 A1 * 1/2012 Bohan ..... F24F 11/63 702/182
2012/0018014 A1 * 1/2012 Fernandes ..... F16L 23/006 137/561 A
2012/0192511 A1 8/2012 Umlor
2013/0186504 A1 7/2013 Maffei
2015/0000382 A1 * 1/2015 Frucht ..... G01M 3/04 73/49.1
2018/0112887 A1 4/2018 Fanelli et al.
2021/0041122 A1 * 2/2021 Fan ..... F24F 11/36

* cited by examiner

MOISTURE AND/OR THERMAL RESISTANCE MONITORING SYSTEM FOR INSULATION-CONTAINING CONDUIT AND METHODS OF USE

FIELD OF THE INVENTION

A method and system for detecting properties of a bulk insulation-containing duct uses a moisture detection system or a capacitance sensing system and electrically conductive materials that are part of the bulk insulation-containing duct.

BACKGROUND ART

Fluids either leaking or condensing within insulating jackets surrounding pipes, ductwork, tanks and other fluid-carrying vessels often leads to corrosion of the conduit or vessel wall and loss of thermal resistance of the insulating material. Exacerbating the problem is the fluids are hidden beneath low-permeability moisture barriers which trap fluids adjacent to conduit and vessel walls, prevent fluids from easily evaporating and make detection of the fluids difficult. Inspection of the insulating jackets and underlying conduit and vessel walls is often not feasible given location of the conduit or vessel and the costs associated with performing the task.

In the case of HVAC ductwork, water condensation is a fairly common condition usually caused by one or more faulty installation practices. Once inside, the moisture can lead to growth of mold and mildew. This can lead to serious indoor air quality problems. There are two primary pathways for moisture to enter ductwork. One is condensation that can occur during the heating season, wherein the condensation can form inside poorly insulated ductwork located in unconditioned spaces. Another is condensation occurring within the duct wall during cooling season as a result of a poorly sealed or damaged vapor barrier.

As warm, moist air leaks into the vapor barrier, it moves through the insulation and contacts the cold surface of the duct core (liner). The moisture condenses out of the air as the dew point is reached on the duct's core surface. When this happens, the insulation material becomes wet and wicks the moisture circumferentially and longitudinally within the duct wall. After some time, the moisture will damage (either by rusting for sheet metal or delaminating for flexible duct) the duct core or liner and allow the moisture to move into the inside of the duct core. Conditioned air can then become contaminated with mold and mildew that often grows in the wet insulation materials. External air from crawl spaces or attics is also free to move into the conditioned air stream.

It is known to use moisture detection devices and capacitance measurement to monitor the properties of ductwork. Common moisture detection devices relying on the conductivity of water to complete an open circuit are prevalent in a multitude of applications. Typically, the devices have two contacts that are isolated from each other—often times an absorbent material is placed between them. In the presence of water, the current is allowed to flow from one contact to the other, thereby powering some type of alarm or other kind of indicator.

Also prevalent in the prior art are capacitance sensors which can be used to determine the presence of water by measuring a change in dielectric permittivity. Capacitors contain two electrical conductors (typically plates) separated by a dielectric. The capacitance of the capacitor can be measured for given dielectric conditions (air, dry materials, etc.). As the properties of the dielectric change, the resulting change in the capacitance can be measured and used as basis for a signal, e.g., an alarm or the like.

These kinds of prior art devices are most often a discreet sensor that is capable of sensing water in a given location. There are examples of water sensors that cover large areas. This is typically done by enlarging both sets of contacts (wires, printed circuits, etched films, etc.) over the area to be monitored. Often, the network of contacts on one side of the sensor will be slightly off-set from those on the other side to prevent false alarms from the contacts being forced together. Regardless of the size or type of sensors employed, the device components, e.g., the electrical contacts or conductors, etc., are designed into the devices and the devices are integrated into the product or space to be monitored. The electrically conductive contacts serve a singular purpose—to function with any water present as part of an electrical circuit for the purpose of providing a warning. If no water is present, the contacts provide no useful function. The same is true for capacitive sensing—the components of the sensor serve the singular function of sensing the change in the capacitance of the dielectric. The sensors add value only in the event of a "failure".

Water sensors for ducts can be probes, rope sensors, float switches, and others. Again, these are discreet sensors that are added to the duct and function separately from the duct components and materials. Detecting the presence of moisture along the length of the duct as well as anywhere around the circumference would require a very large sensor or many smaller sensors to cover the surface area. Most prior art sensors for ductwork require additional labor and installation steps—especially for sensing the entire surface area or even a large percentage thereof. Therefore, the prior art sensors can be difficult and expensive to apply.

In the case of flexible ducting, most of the prior art water sensors are not practical given the packaging and installation requirements for the products. Flexible ducts are manufactured at a factory where they are longitudinally compressed into a package for shipment and handling. The layered construction of these kinds of ducts is well known and a description of the various component parts of the duct can be found in U.S. Pat. No. 10,295,218 to Campbell et al., which is incorporated in its entirety herein. Any prior art devices incorporated into these kinds of ducts could be subject to damage given the extreme compression ratios used in the duct packaging process.

In addition, integrating the prior art into the flexible ducts during manufacturing would also be difficult. The sensors would have to be dispersed throughout the product or accurately placed in desired locations and somehow fixed to or inserted between the duct components to prevent excessive movement during handling, packaging, and/or installation. Those prior art sensors employing metallic components or other rigid or semi-rigid parts could likely damage the duct components themselves during the packaging process. Depending on the quantity of prior art sensors used and the type employed, the thermal resistance of the product could be reduced by unintentional compression of insulation and/or creating a thermal bridge across the duct wall cavity.

An example of a teaching regarding monitoring the moisture or configuration of a duct is found in Pre-Grant Publication No. 2018/0112887 to Fanelli et al. In this prior art, a duct construction is monitored using both moisture and capacitance measurement. Fanelli et al. does not provide any details as to how this monitoring is accomplished though. Other moisture detection devices using various-shaped electrodes that are positioned on the product or in the area of moisture detection would still be required. These prior art systems are all complicated and include additional components to permit the moisture detection or capacitance detection to be viable, particularly for HVAC ductwork.

Another problem that can occur with HVAC ductwork is a compromise in the thermal resistance of the duct. That is, the duct can be compressed or crimped and lose some if not all of its insulating value.

One of the primary concerns about the viability of using flexible duct is the poor installation of the product. This includes excessive compression from routing the duct improperly, excessively tight bends, overly tight duct supports/hangers, etc. All of these conditions contribute to the compression of the insulation material and subsequent loss of thermal resistance. Sheet metal ducts are also subjected to many of the same issues that result from loss of thermal resistance as well. Loss of thermal resistance not only necessitates the use of more energy to maintain the desired temperature, it also can lead to condensation on the outside of the duct moisture barrier. In areas of the duct where insulation is excessively compressed, the condensate may run off the moisture barrier surface and damage other parts of the surrounding structure.

As such, a need exists to provide improved systems and methods for monitoring ductwork from the standpoint of humidity conditions and methods for optimizing duct installation to prevent the loss of thermal resistance of the duct insulation material.

SUMMARY OF THE INVENTION

The invention provides an advantage over the known types of moisture detecting systems by using existing components of the duct or other fluid-carrying conduit to provide a way to monitor the ductwork/conduit for moisture or a change in the duct/conduit configuration.

In one embodiment, the inventive system uses a duct having a liner, insulation, and a vapor barrier. The duct includes electrically conducting materials on or as part of the outer surface of a liner of the duct and the inner surface of the vapor barrier of the duct. These inner and outer surfaces are separated by a bulk insulation, which is preferably a fiberglass batt insulation or similar absorbent insulation material.

For the system designed to detect moisture, means are provided to monitor moisture between the liner and vapor barrier using the electrically conductive inner and outer surfaces of the liner and vapor barrier, respectively.

In one mode, the means can use an electrical circuit, which included a power source and a signal device. Completion of the circuit would activate the signal device and the signal device would provide an indication that moisture is present between the liner and vapor barrier.

In another mode, the means can use capacitance as a measure of a condition between the liner and the vapor barrier. By using a capacitance measuring device, a signal device, and the electrically conductive surfaces of the liner and vapor barrier, a change in capacitance due to moisture present in the space between the liner and vapor barrier can be sensed and the signal device can provide an indication of moisture so that the proper corrective measures can be taken.

In yet another mode, the means for monitoring capacitance for the duct can also provide an indication that the configuration of the duct with respect to the spacial relationship between the liner and vapor barrier has changed. This change in configuration can be an indication that the thermal resistance of the duct has been compromised, e.g., the duct may be kinked, compressed, decompressed or the like and remedial action can be taken once the change is detected.

The invention also includes methods of monitoring for moisture and changes in thermal resistance. Moisture detection methods can use either the electrical circuit embodiment or the capacitance measuring embodiment. Methods for detecting changes in thermal resistance can employ the capacitance measuring embodiment. These methods use the electrically conducting surfaces of the duct to either complete a circuit and provide an indication of moisture in the duct or use the electrically conducting surfaces of the duct to measure capacitance between the electrically conducting surfaces for either moisture detection in the duct or changes in thermal resistance of the duct.

The invention also provides a unique way to make an electrical connection to the electrically conductive surfaces of the liner and vapor barrier. This aspect of the invention involves an electrode that is configured to provide a solid connection between leads of either the moisture detection system or capacitance measuring system of the invention and the outer surface of the liner and inner surface of the vapor barrier.

As one example, the means for moisture detection can be either:

- a moisture detection circuit comprising a power source, a signal device, and wiring, a first end of the wiring of the circuit connected to the electrically conductive material of the liner and a second end of the wiring connected to the electrically conductive material of the vapor barrier, the power source and signal device located in the circuit between the first end and second end of the circuit, wherein when moisture is present in the bulk insulation to complete the circuit between the first and second ends, the signal device is powered to provide an indication of the presence of moisture in the duct, or
- a capacitance sensing circuit comprising a power source, a capacitance measuring device, a signal device, and wiring, a first end of the wiring of the circuit connected to the electrically conductive material of the liner and a second end of the wiring connected to the electrically conductive material of the vapor barrier, the capacitance measuring device and signal device located in the circuit between the first end and second end of the circuit, wherein when the capacitance measuring device detects a change in capacitance from an initial capacitance for the duct, the signal device is powered to provide an indication of a change in capacitance in the space between the electrically conductive materials of the duct.

One example of the means for monitoring thermal resistance can be a capacitance sensing circuit comprising a power source, a capacitance measuring device, a signal device, and wiring, a first end of the wiring of the circuit connected to the electrically conductive material of the liner and a second end of the wiring connected to the electrically conductive material of the vapor barrier, the capacitance measuring device and signal device located in the circuit between the first end and second end of the circuit, wherein when the capacitance measuring device detects a change in capacitance from an initial capacitance for the duct, the signal device is powered to provide an indication of a change in capacitance in the space between the electrically conductive materials of the duct.

Another embodiment of the invention is not limited to a duct using a liner, insulation, and a vapor barrier. In this other embodiment, a fluid carrying conduit can be used that includes an inner conduit, an outer member, and a space between the inner conduit and outer member. The inner conduit and outer member are equipped with the same kind of electrically conducting material on the respective outer and inner surfaces so that either moisture or thermal resistance of the fluid-carrying conduit can be monitored. The space can have an insulator that could have its capacitance monitored for either moisture or thermal resistance monitoring. Air can be the insulator if so desired when monitoring using capacitance measurement and thermal resistance. When monitoring for moisture using an electrical circuit, the space has an insulator that would allow completion of the electrical circuit if moisture enters the space. The fluid-carrying conduit can be flexible like the duct using the liner, insulation, and vapor barrier, or can be rigid if the particular application of carrying the fluid requires a rigid structure.

Another embodiment of the invention is the manner in which the systems are associated with a given duct or fluid-carrying conduit when installed for use. Connections are made to the electrically conductive surfaces of the inner conduit/liner and outer member/vapor barrier. In this embodiment, the means for monitoring moisture or thermal resistance is configured so that it can be located in a desired place using components that are used to install a given duct or fluid-carrying conduit. Having the monitoring means so configured means that the installer does not need any extra equipment or tools to mount the monitoring means in a given location for monitoring purposes.

Another embodiment of the invention relates to leak detection in a system where insulation is not needed. In this embodiment, the combination of the outer member, fluid-carrying conduit and space between can be used to detect whether a leak occurs in the fluid-carrying conduit. The space can be occupied with an absorbent material or media that would allow for either capacitance measurement or detection of moisture using an electrical circuit. The space would just have air in it and the capacitance measurement mode of the invention could be utilized. The fluid-carrying conduit could be a metallic pipe that would provide an electrically conductive outer surface and the outer member could either include the other electrically conductive surface or be electrically conductive itself. Since insulation is not required, the space could employ a minimal amount of absorbent media, enough to measure a capacitance change or create an electrical pathway if the media is wetted by a leak, or a minimal air gap for capacitance measurement.

The fluid-carrying conduit could be any conventional type that would provide the electrically conductive surface and the outer member could be a sleeve or the like to fit over the fluid-carrying conduit and position the absorbent media or create the air gap between the outer member and fluid-carrying conduit for leak detection using the moisture detection or capacitance measurement modes of the invention.

Another embodiment of the leak detection system of the invention uses a non-conductive inner conduit and an electrically conductive material, that is either part of the non-conductive pipe or surrounding the inner conduit, the electrically conductive material having a plurality of openings therethrough. The openings allow for the passage of fluid through a leaking inner conduit and through the electrically conductive material surrounding the inner conduit. Once this fluid enters the space between the two electrically conductive materials, the capacitance sensing circuit can detect the leak in the inner conduit and the appropriate action can be taken. The electrically conductive materials can be the same used for the other embodiments of the invention.

In one embodiment of the leak detection system, the electrically conductive material is a polyester metallized film that has generally circular openings ranging from 1/16 of an inch to an inch in diameter, with the openings spaced apart by about 1/16 inch to about 2 inches. In another embodiment, the openings can be sized to be at least 5% of the area of a two dimensional electrically conductive material, e.g., a film, or at least 5% in terms of a porosity of a three dimensional electrically conductive material, e.g., a wool or mesh.

DETAILED DESCRIPTION OF THE INVENTION

Figure 1A:
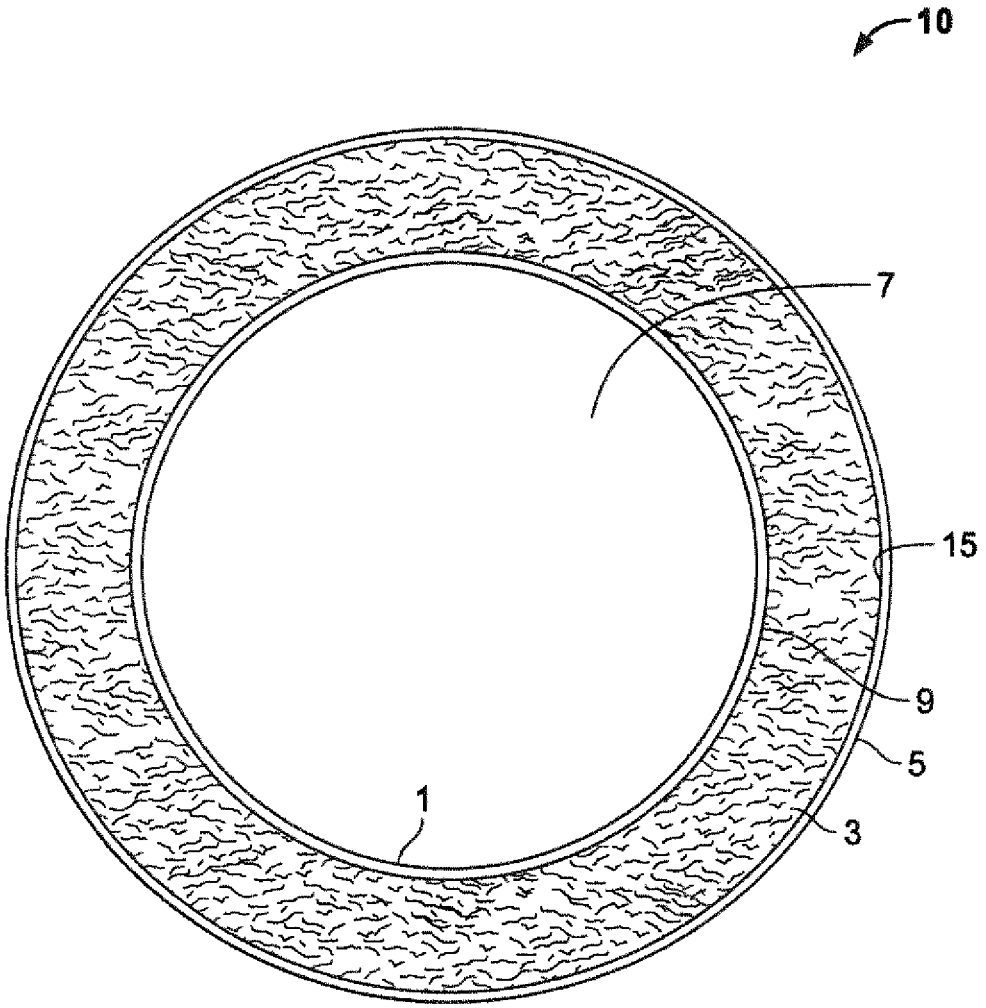
FIG. 1*a* is a cross section of a duct that is part of either a moisture detection system or thermal resistance detection system.

One aspect of the invention is the use of insulated flexible fluid, e.g., air, duct that senses water over the entire duct wall area without the addition of electrodes, contacts, or absorbent material. The invention utilizes dual-purpose primary components to function as both structural/performance components and as sensor components. Further, the invention accomplishes total duct wall sensing without any of the limitations of the prior art associated with packaging, handling, and installation.

Each of the primary flexible duct components—liner, bulk insulation, and vapor barrier—provides value during "normal" operating conditions and also provides value during a "failure" condition. The dual functionality of primary duct components is as follows:

1. Duct Core/Liner—

Traditional Function: Provides a leak-resistant channel through which conditioned air is conveyed.

Sensor Function: The outer surface of the duct core/liner acts as a continuous electrically-conductive contact.

2. Bulk Fibrous Insulation—

Traditional Function: Provides thermal and acoustical resistance over the entire area of the duct wall, including the duct length.

Sensor Function: Acts as an absorbent reservoir between the outside surface of the liner and inside surface of the barrier. In the case of using the duct in connection with capacitance sensing, the insulation and air held within the porous spaces acts as the dielectric material.

3. Vapor Barrier—

Traditional Function: Provides a barrier from moisture entering the fiberglass and holds the fiberglass in position around the core Sensor Function: The inner surface of the vapor barrier acts as a second continuous electrically-conductive contact.

Any electrically conductive film, foil or laminate can be used on or as part of the outer surface of the duct liner and the inner surface of the vapor barrier. These materials can be those that are used regularly to construct duct components and provide the performance characteristics required for the "normal" or traditional function of the duct. In addition, when these conductive surfaces are facing inward toward the insulation material, they are in intimate contact with the insulation material throughout the duct wall. Any moisture that enters the duct through an opening in the vapor barrier or through condensation within the duct wall or space between the liner and vapor barrier will cause the insulation material to become wet and either:

1) establish continuity between the contacts—the conductive surfaces of the core and vapor barrier respectively and/or;
2) change the dielectric properties of the space between the conductors (the surfaces of the duct liner and vapor barrier).

Establishing of the continuity or notation of the change in capacitance allows for an indication of these conditions so that the duct can be checked for a problem, either due to moisture when using either electricity or capacitance or a change in thermal resistance when using capacitance.

The duct used in the invention can be manufactured utilizing current technologies. The invention can be packaged in the same manner as currently-made flexible duct. Costs are the same or nearly the same as those of current flexible ducts as well. Once the duct is made, the other components of the systems can be easily added either prior to shipping the duct to a location for installation or at the installation location if so desired. Preferably, the system components are added to the duct once made so that the duct is ready for installation without any efforts on the part of the installer.

The conductive films, foils, or laminates used for constructing the duct core and the duct vapor barrier are preferably those that have low electrical sheet resistance. These kinds of materials allow for a low voltage DC power source to connect at one point along the length of the liner or vapor barrier. Aluminum metallized polyester films are very commonly used in the construction of these duct components. Even at extremely thin coating level, e.g., those ranging from 5 to 50 nm, the surface resistance of typical aluminum metallized polyester films is less than 5 ohms/sq. This provides for a very cost-effective application of low voltage signaling devices—lights, alarms, transmitters, etc.

Installation of the inventive duct would be similar or the same as current flexible duct products. In order to enable water sensing capabilities of the inventive duct using electricity, one lead would be connected (clipped, glued, clamped, etc.) to the inner surface of the vapor barrier and a second lead connected to the outer surface of the duct core. The leads would, in turn, be connected to the power source terminals with any signaling devices. Access to the duct liner outer surface and vapor barrier inner surfaces—for easy attachment of the leads—would easily be made at the end of a given duct run where the liner and vapor barrier ends are exposed prior to attachment to a fitting.

As mentioned above, another preferred embodiment of the inventive duct is utilizing the duct itself as a cylindrical capacitor whereby the duct liner and vapor barrier are used as the conductors and the fiberglass insulation or other material between the conductors are used as the dielectric material. Upon installation of a duct, the conductors are charged and the initial capacitance of the duct is determined. Given that the geometry of the duct is generally not subject to change once installed, changes in the capacitance of the duct can be attributed to changes in the dielectric—most likely from moisture intrusion. Thus, the capacitance of the duct can be monitored over time and any changes would then be a sign that a moisture problem may exist for the duct. A later change in capacitance after installation of the duct can also indicate that a physical change has occurred with respect to the duct, such change possibly compromising the thermal resistance provided by the duct.

The use of capacitance measurement for thermal resistance monitoring can be especially advantageous in terms of optimizing duct installations. As noted above, improper installation of any kind of ducting or piping in a given structure can cause problems down the line, including the ducting or pipe not providing the desired thermal resistance for the fluid passing through the duct or pipe.

During installation of a new duct or pipe that contains insulation, the insulation will be typically dry or of a consistent moisture content. When taking an initial capacitance measurement at the time of install or shortly thereafter, this initial capacitance measurement can quantify how the duct compares to an ideal duct (the capacitance measurement of an ideal duct would be known), i.e., one that is straight or following the proper routing for a given installation, is not kinked or compressed, and the like. If the capacitance measurement were to indicate some variation from the ideal duct capacitance, an installer could make a change to the way the duct is installed to determine if the duct capacitance better matches the ideal duct. The change procedure could be iterative in that the installer could make consecutive alterations to the installation, e.g., alter the run direction, modify or use different kinds of support mechanism, change bend radii, etc., to ensure that the capacitance after the iterative installation approximates the ideal duct. The iteration could be just one change but several changes in series could also be made. Using the capacitance measurement embodiment of the invention allows for an optimization of the duct installation and to get the duct or pipe installed so that its thermal resistance would be at its maximum. Such processes could also be used to minimize friction loss of fluids flowing through the duct as most conditions that would negatively affect the thermal resistance would negatively affect the fluid flow within the conduit.

In conjunction with the description of the invention above, embodiments of the invention are described in connection with both moisture monitoring in the duct using either an electric circuit or capacitance measurement as well as the embodiment of invention that uses capacitance measurement to monitor thermal resistance changes in the duct during installation and over a later time after installation.

Figure 1B:
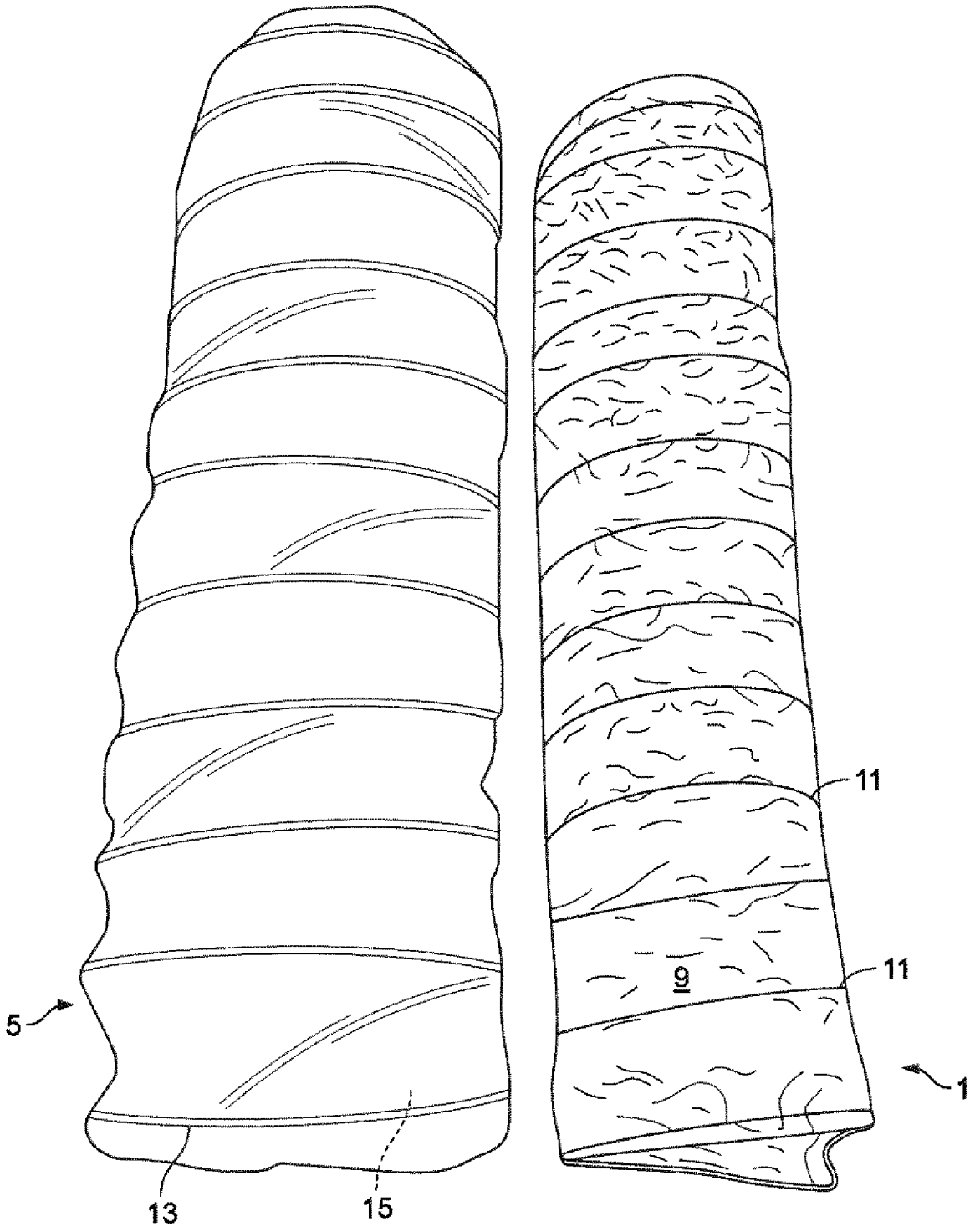
FIG. 1*b* shows two parts of the duct of FIG. 1A in a separated state, and without the bulk insulation layer.
Figure 2A:
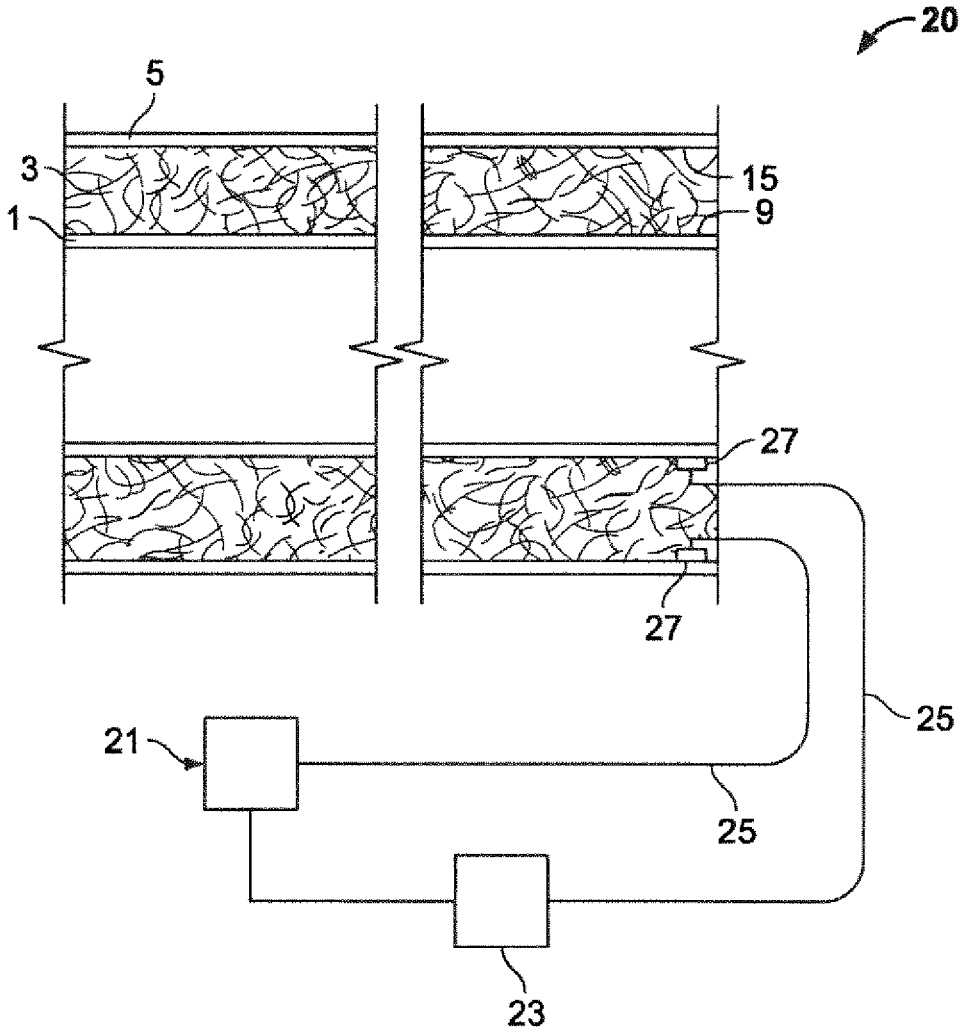
FIG. 2*a* is a schematic drawing of one embodiment of the moisture detection system using an electrical circuit.
Figure 2B:
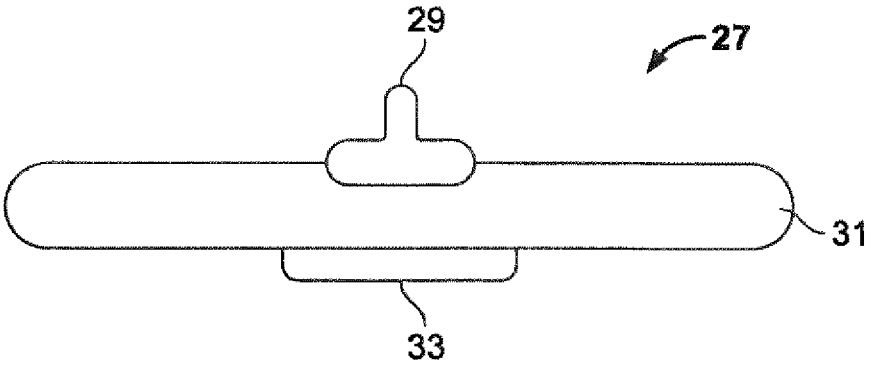
FIG. 2*b* shows an exemplary connection device for the leads of the circuit of FIG. 2*a*.
Figure 3A:
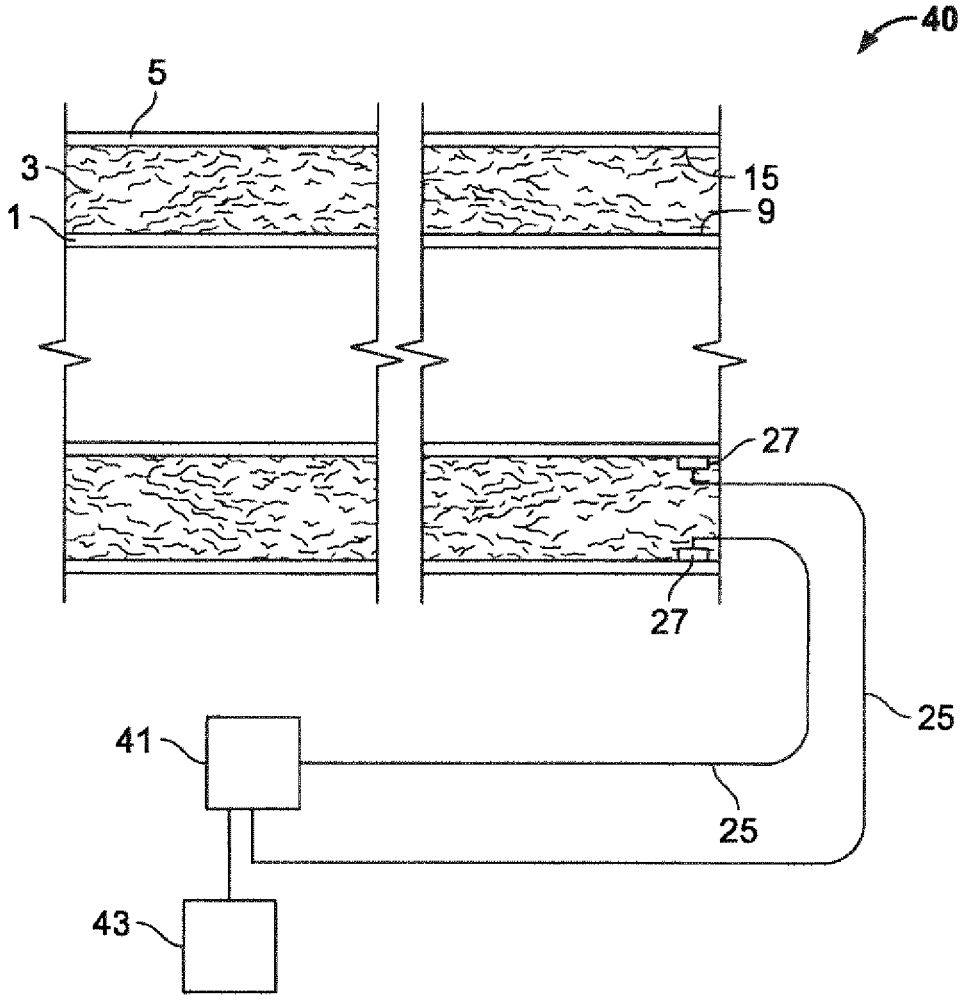
FIG. 3*a* is a schematic drawing of another embodiment of the moisture and/or thermal resistance monitoring system using a capacitance sensing circuit.
Figure 3B:
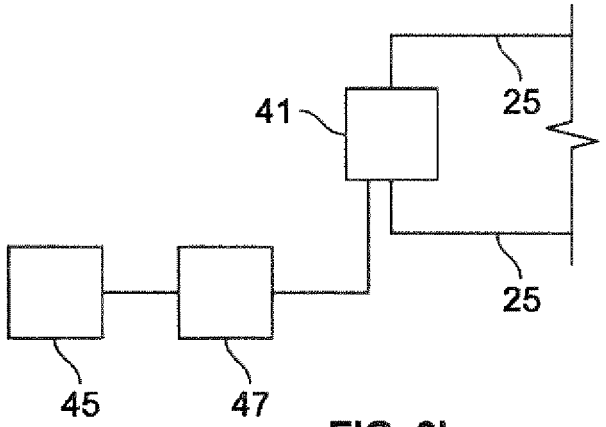
FIG. 3*b* shows an alternative embodiment to the system of FIG. 3*a*.

FIGS. 1*a*-2*b* relates to the embodiment of the invention wherein moisture monitoring of the duct is practiced using an electric circuit with FIGS. 3*a* and 3*b* showing the embodiment of the invention using capacitance measurement for moisture monitoring.

FIG. 1*a* shows a cross sectional schematic view of a flexible duct typically used in HVAC systems, the duct designated by the reference numeral 10. The duct has three basic component parts, a liner 1, a layer of insulation 3, which is usually a bulk insulation like fiberglass batt, and a vapor barrier 5.

The liner 1 can have any number of constructions so as to form a channel 7 for conditioned air of the like to flow through. One preferred construction is a two part construction, which includes a polymer film and an outer surface, which includes a metallized polyester, e.g., polyethylene terephthalate (or PET) film, which is designated by the reference numeral 9. This outer surface 9 can be made in any number of ways. As noted above one example is a film that has a metallized outer surface, typically made of a reflective material like aluminum. This film can then be adhered to the polymer film using an adhesive. This film is also an electrically conductive component of the duct 10.

As the electrical conductivity of the outer surface of the liner is an aspect of the invention, the duct 10 could be made with the liner having a different construction, i.e., not a film but still with an outer surface that is electrically conductive. Since the use of films in HVAC ducts is already an established feature of these kinds of ducts, having the outer surface on the liner provide the electrical conductivity using a material like aluminum is a preferred method of providing electrical conductivity along the outer surface of the liner and along both its circumferential and longitudinal lengths.

Referring to FIG. 1*b*, the liner 1 can also include a helical support 11, which can be positioned between the polymer film and the conductive film of the liner 1. A scrim as is known in the art could also be used as part of the liner.

The vapor barrier 5 is a conventional layer used in ductwork and is commonly constructed of either a tubular extruded polyethylene film or one with a fiberglass rip-stop, i.e., a scrim, sandwiched between layers of a polyester film. The vapor barrier 5 could also include a helical support 13 to help maintain the cylindrical integrity of the vapor barrier 5.

In the case of the invention, the vapor barrier is also made with an electrically conductive inner surface 15, which in combination with the electrically conductive outer surface of the liner allows for moisture and/or thermal resistance monitoring using the duct construction itself.

In a preferred mode, the vapor barrier 5 is made with its inner surface 15 being a conductive film similar to that of the outer surface 9 of the liner 1. For example, the inner layer of the vapor barrier can be a metallic-coated polyester film and a preferred polyester is polyethylene terephthalate. A polyester or fiberglass scrim may be used as part of the duct construction. In fact, any type of known vapor barrier can be used to surround the bulk insulating layer 3 providing that the vapor barrier has an electrically conductive inner surface 15. The vapor barrier 5 can be attached to the insulation using an adhesive or surround the insulation without attachment. The vapor barrier could also include a low-e outer surface for insulating purposes as well.

The duct 10 could also have other features as well in addition to the core components of the liner, vapor barrier, bulk insulation, and electrically conductive surfaces. For example, other layers of materials could surround the vapor barrier, e.g., another low-e film or the like, bulk insulation and an additional vapor barrier. The duct 10 of the invention is not limited in terms of any additional structure that may be employed as along as the arrangement of the liner, vapor barrier, bulk insulation and electrically conductive surfaces are present.

Referring now to FIG. 2*a*, one embodiment of the invention in terms of monitoring moisture conditions in the duct 10 is shown and the circuit for monitoring moisture is designated by the reference numeral 20. Component parts of the circuit 20 include the electrically conductive inner surface 15 of the vapor barrier 5, the electrically conductive outer surface 9 of the liner 1, a power source 21, a signal device 23, and electrical conductors/wiring or leads 25 that would complete the circuit between the inner surfaces 9 and 15, the power source 21 and the signal device 23.

The power source can be any kind of a power source, DC or AC, or a combination thereof. Batteries could be used as a back up as well if AC power were used and lost for some reason.

The signal device can also be any kind of a device that provides a signal that the circuit has been completed as a result of moisture being present between the electrically conductive surfaces 9 and 15. Examples of such devices would be a light, an audio signal, or a wireless transmitter. In the case of a wireless transmitter, the signal therefrom could be received via an app on a mobile device, a central monitoring location, or any other receiver in any location that would permit action to be taken once a signal representative of moisture detection in the duct is received. While the power source and signal device are shown as separate components of the circuit, they could be combined as one unit. Also, these components could be mounted anywhere, including to structure near the duct being monitored or mounted to the duct itself using some type of attachment, e.g., fasteners like clamps, adhesives, combinations thereof, or the like.

The electrical connection between the leads 25 and electrically conductive inner and outer surfaces 9 and 15 can be any type. The leads could be clipped, glued, or clamped to the surfaces 9 and 15. One option for an electrical connection is using an electrode similar to those used in electromyography (EMG), which are used for measuring muscle activity by detecting its electric potential, or sensors used in electrocardiograms (EKG), which monitor the heart's electrical activity. A schematic view of such an electrode 27 is shown in FIG. 2*b*. The electrode 27 includes a button-shaped metal connector 29, e.g., Ag—AgCl material, disposed on a material pad 31 that has a conductive material associated therewith. The material pad 31 is designed to adhere to the electrically conductive surfaces of the liner and the vapor barrier and provide an electrical connection between the surfaces of the liner and vapor barrier and connector 29. Preferred materials for the material pad 31 include an electrically conductive tape, gel, foam, or adhesive. The end of a lead would be equipped with another connector (not shown) to snap to the connector 29.

In a preferred embodiment, the electrode 27 is made with a conductive epoxy layer 33 that is applied to one side of the material pad 31 and in electrical connection with the connector 29, the conductive epoxy providing the adherence to each surface of the liner and the vapor barrier. The conductive epoxy provides a better connection to the electrically conductive surfaces of the liner and the vapor barrier, especially when these surfaces are made of a metallized film like that commonly used in HVAC ductwork. Conductive epoxies are readily available so that any type would be suitable for use as part of the electrode 27.

As an alternative to the electric circuit of FIGS. 2*a*-2*b* for moisture detection, FIGS. 3*a* and 3*b* show a circuit 40 that uses capacitance measurement for moisture detection. The circuit 40 uses the same inner and outer surfaces 9 and 15 of the duct 10 and leads 25. The difference is the use of a capacitance measuring device 41, which is disposed between the leads 25 that connect to the inner and outer electrically conductive surfaces 9 and 15. As is commonly understood, the capacitance measuring device, which includes a power source and functions as a data acquisition device when measuring capacitance, would send a current to the electrodes, measure voltage, and then use the voltage to calculate a capacitance. Also, in the case of cylindrical ducts or conduits it can be seen from the cylindrical capacitance equation, i.e., ($C=2\pi\varepsilon L/\ln(R_2/R_1)$), $\varepsilon$ represents the permittivity of the dielectric, which in one embodiment is fiberglass insulation and the air contained therein. The value of $\varepsilon$ changes dramatically as moisture builds in the fiberglass and the accumulating water displaces all or part of the air; thereby, changing the capacitance. Therefore, using the duct as a capacitor, i.e., the inner and outer surfaces 9 and 15 and the space therebetween with the bulk insulation therein, one can monitor the capacitance and determine when a change in capacitance occurs, and use this change to check on the duct for moisture problems. Capacitance measuring devices are well known in the art and any type could be employed in connection with the system using capacitance for moisture or thermal resistance monitoring. Since these devices are well known in the art, a detailed explanation is not needed for understanding this aspect of the invention. The capacitance measuring devices are preferably made on a small scale so that they can be easily installed in connection with the ductwork and attachment to the electrically conducting surfaces of the liner and the vapor barrier, e.g., attached to the duct or to structure in close proximity to the duct.

As is the case for the moisture detection circuit of FIGS. 2*a* and 2*b*, the circuit 40 of FIG. 3*a* would also be equipped with a signal device 43. The signal device could be like that described for FIG. 2*a* and send some type of an alert that the capacitance for the duct being monitored has changed.

When using the circuit 40, a baseline capacitance would be measured for a dry duct. As the capacitance is measured subsequently, either continually or at measured intervals, the baseline capacitance would be compared to the measured capacitance. This comparison could be done by the capacitance measuring device 41 and when a change is occurred, the device 41 would activate the signal device to send the appropriate alert for action to be taken.

Referring to FIG. 3*b*, the comparison could also be made by a separate device wherein the capacitance measuring device 41 could take capacitance measurements over time and send them to a remote comparator 47 for the comparison to the baseline measurement and action can be taken based on the comparator determination that a change in capacitance has occurred, e.g., send a signal to a signal device 45.

In another aspect of the invention, the capacitance measurement circuit 40 can also be used to monitor the thermal resistance of the duct 10. This mode is useful if the duct configuration could be changed in such a way that the thermal resistance of the duct would be compromised. For example, the duct could be kinked or otherwise configured where the duct wall would be compressed upon installation and, if this condition is not detected, the thermal resistance of the duct could be compromised and the insulating effect of the duct would be impaired. When establishing a baseline capacitance to monitor thermal resistance, the duct should not only be dry but be in a normal operating configuration, i.e., not in a state where the thermal resistance of the duct could be compromised by kinking, compression, decompression, or the like. If the duct configuration is not in a normal operating state, an accurate baseline capacitance could not be determined for monitoring thermal resistance of the duct.

More particularly, utilizing the duct 10 as a cylindrical capacitor allows for measuring compression of the wall cavity between the vapor barrier and liner and insulation therein (fiberglass). This correlates to changes in the overall thermal resistance of the duct. In the case of cylindrical ducts or conduits it can be seen that from the cylindrical capacitance equation ($C=2\pi\varepsilon L/\ln(R_2/R_1)$), that as the ratio of an installed duct's inner and outer radii change, the capacitance changes. For a given length duct, the capacitance changes based on the change in radii, e.g., a compression. This makes a reasonable assumption that the moisture content of the fiberglass is not changing during installation as insufficient time has elapsed for moisture to enter into the duct. In other words, if the circuit 40 is used at the time of installation of the duct, capacitance measurements can be made and compared to baseline measurements of ducts of the same length to help optimize the installation for insulating value—i.e. minimization of duct wall compression. Changes in capacitance during installation would be due to some change in the duct shape or configuration, e.g., a change in the radii of the liner and vapor barrier and not due to accumulation of moisture between the liner and the vapor barrier. Once the capacitance change is sensed at this time, the appropriate alert or signal can be generated, the duct can be inspected, and any problem with its configuration could be corrected. Once the duct is in place and the installation is complete (capacitance will not likely ever match the baseline, but it should approach it as compression to duct wall is minimized. Baseline would be perfectly straight, non-compressed sample of a given length not likely to occur in a real installation), any further changes in capacitance are most likely due to the moisture problems as the duct configuration or arrangement is not likely to be disturbed once installed in a given structure.

For the capacitance measuring embodiment of the invention, an actual capacitance measurement test was conducted. An actual capacitance measurement of a dry section of duct like that of FIG. 1*a* was made, the duct also in a normal operating state in terms of the relative positions of the liner and vapor barrier. This measurement was 291.9 pico-farads. For the same section of duct, approximately 6 ounces of tap water were poured into an opening in the vapor barrier. The capacitance was measured after the water was introduced into the insulation via the hole in the vapor barrier. The measurement was 16.8 nano-farads (16800 pico-farads)—an increase of greater than 57 times. This is expected given the permittivity of water is around 80 at room temperature and the permittivity of air, held within the porous fiberglass, is essentially 1. So, the inventive duct is capable of detecting a small increase in moisture within the duct wall using capacitance measurement and the electrically conductive surfaces of the liner and the vapor barrier, and the material therebetween.

Figure 4A:
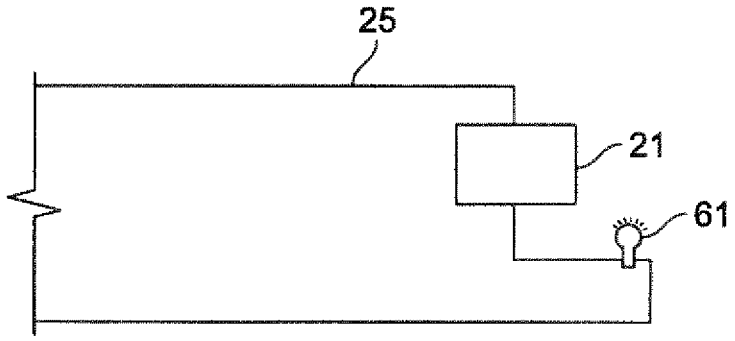
FIG. 4*a* shows one embodiment of a signal device for the moisture detection system using an electrical circuit.

FIGS. 4*a*-5*c* illustrate different signal devices for use in either the circuit 20 or the circuit 40 described above, with other parts of the duct system omitted for clarity purposes. FIG. 4*a* shows a circuit 30 using a signal device as a light 61. Ideally, the light 61 is an LED device, which can be powered with low voltages, which could be typical of the moisture detection circuit 20. However, any type of lighting device could be employed to provide a signal that the duct needs attention.

Figure 4B:
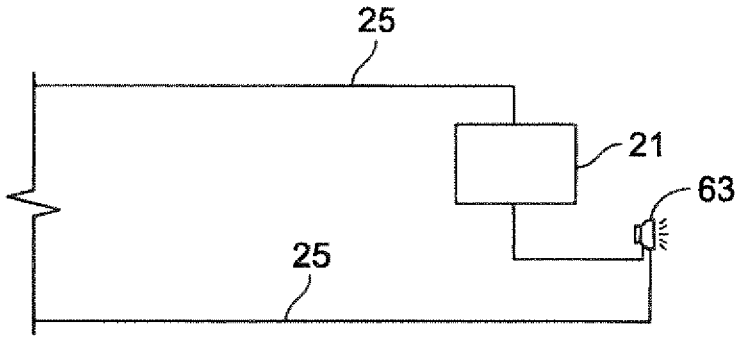
FIG. 4*b* shows a second embodiment of a signal device for the moisture detection system using an electrical circuit.

FIG. 4*b* shows an audio alarm 63, wherein completion of the circuit would produce an audible signal to provide an alert that the duct requires checking for moisture.

Figure 4C:
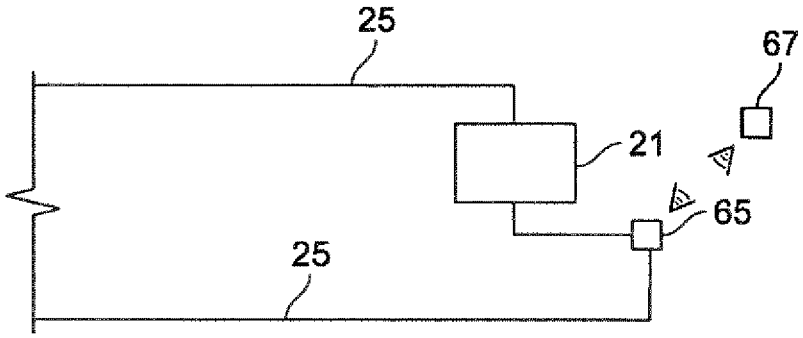
FIG. 4*c* shows a third embodiment of a signal device for the moisture detection system using an electrical circuit.

FIG. 4*c* shows a wireless transmitter 65, which can be designed to transmit a signal upon completion of the circuit due to moisture between the two electrically conductive surfaces 9 and 15. A receiver 67 for the transmitter can be located in virtually any location capable of receiving the transmitted signal from the transmitter 65. The receiver 67 could either communicate with the signal device or have one incorporated therein to provide the necessary alert for action to be taken based on the received signal.

Figure 5A:
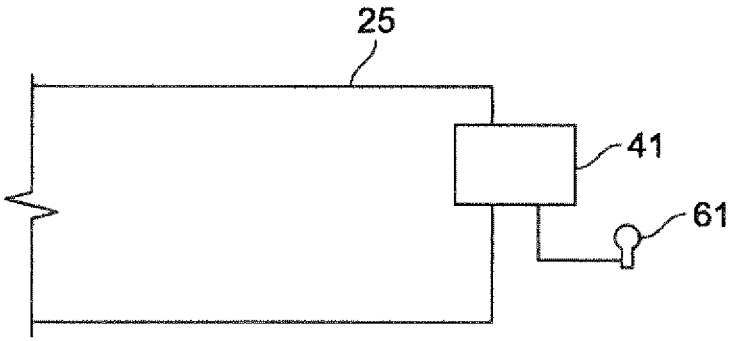
FIG. 5*a* shows one embodiment of a signal device for either the moisture detection system or the thermal resistance system using capacitance measurement.
Figure 5B:
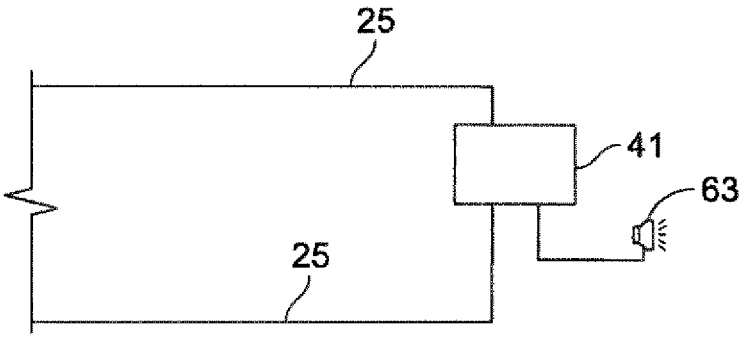
FIG. 5*b* shows a second embodiment of a signal device for either the moisture detection system or the thermal resistance system using capacitance measurement.
Figure 5C:
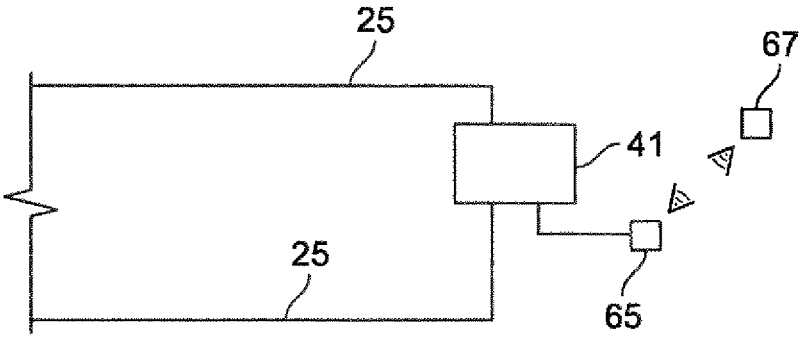
FIG. 5*c* shows a third embodiment of a signal device for either the moisture detection system or the thermal resistance system using capacitance measurement.

The same arrangement of signal devices would be used for the capacitance measuring circuit 40 and these are shown in FIGS. 5*a*-5*c*. FIG. 5*a* shows the capacitance measuring device 41 in combination with a light 61. FIG. 5*b* shows the capacitance measuring device 41 in combination with an audible alarm 63, and FIG. 5*c* shows the capacitance measuring device 41 in combination with a transmitter 65, which is in turn able to transmit to a receiver 67 so that the appropriate alert can be generated for action to be taken in connection with the duct being monitored.

Figure 6:
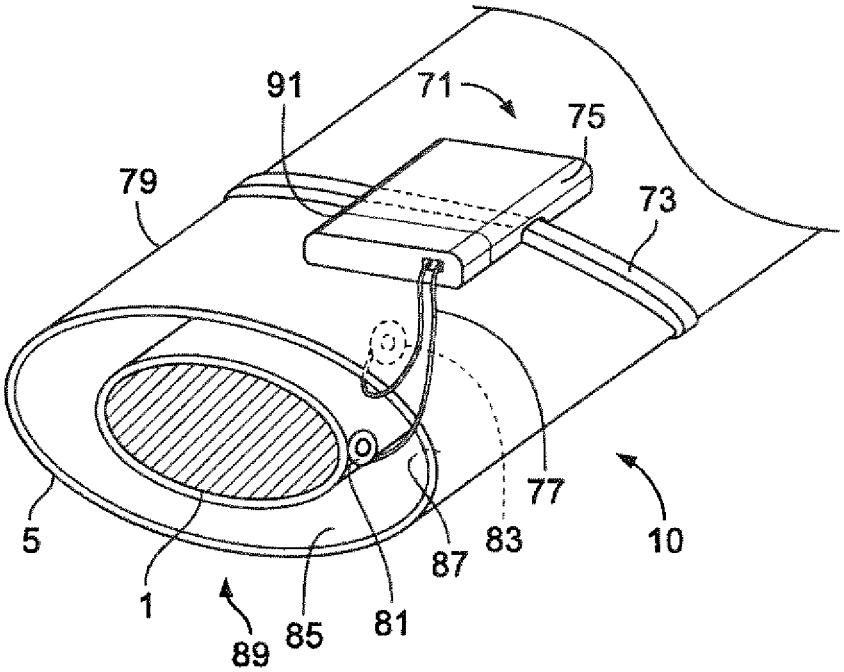
FIG. 6 shows a schematic assembly of a capacitance measuring device installed on a duct that is monitored for moisture and/or thermal resistance.

FIG. 6 shows one example of mounting a capacitance measuring device to a duct for the capacitance monitoring embodiment of the invention. The capacitance measuring device is designated by the reference numeral 71. A strap 73, which is like a typical cable tie, is used to strap the device 71 to the duct 10. The device 71 has a housing 75 that contains the necessary circuitry to allow the leads 77 and 79 and their respective electrodes 81 and 83 to measure capacitance once the electrodes 81 and 83 are secure to the electrically conducting surface 85 of the liner 1 and electrically conducting surface 87 of the vapor barrier 5. For illustration purposes, the bulk insulation is not shown to better show the mounting of the electrodes. The duct 10 is shown with an end 89, which would be used to connect to the desired fitting to connect the duct to the system handling the conditioned fluid for travel through the liner. The end 89 is employed as the access point for the electrode attachment so that the integrity of the duct wall length can be maintained and no openings are required to be made.

The housing 75 has a cover 91 that allows access to the circuitry in the housing 75 and provides a passageway for the leads to enter the housing. The housing is preferably less than 2 inches square so as not to interfere with the duct or any surrounding structure. Of course, the leads 77 and 79 could enter the housing 75 in other locations. The housing 75 can also have one or more slots to receive the strap so that it is easily connected to the housing for securement to the duct 10. The strap ends (not shown) are secured together as is commonly done for these types of securing devices. While not shown, a similar mounting could be employed for the components used in the moisture monitoring system using an electric circuit. That is, the signal device and power source could be attached to the duct in the same way as the capacitance measuring device is in FIG. 6.

The mounting of the device in FIG. 6 provides an advantage in that the cable tie can already be attached to the housing so that the installer only needs to secure the strap ends together to securely mount the device in place. The electrodes are also easily attached to the outer surface of the liner and inner surface of the vapor barrier at the duct end. In fact, the device and its electrodes can be mounted to the duct as part of its manufacturing so that an installer would only still need to mount the duct in its desired location and not spend any additional time mounting the moisture or thermal resistance monitoring devices.

In yet another embodiment, the strap 73 can be the same strap that is typically used to secure the end of a duct to a duct fitting, e.g., an elbow for example. In this mode, the strap serves a dual-purpose role, one for securing the duct to a given fitting and another one to secure the device, whether it is for capacitance measurement or completing an electric circuit, to the duct itself. Since the attachment of the duct to a fitting is at the end of the duct run, the device is optimally located at the end of the duct so that the electrodes can be easily attached to the surfaces of the liner and the vapor barrier. In this mode, the need for an additional strap to secure the device is avoided. Since these kinds of fitting are well known, a further description is not needed for understanding of the invention. Further yet, the component parts of either the moisture detection or capacitance measurement embodiments of the invention could be just attached to the fitting that connects to the duct end as well. That is, a strap or other kind of fastener could be used to secure the housing to the duct fitting instead of the duct itself.

FIG. 6 illustrates one means for attaching the component parts of either the moisture detection or capacitance measurement embodiments of the invention to the duct or fitting itself or means that can be used to both secure the component parts to the duct and the duct to a fitting that is to be attached to an end of the duct. However, other means, e.g., adhesives, the combination of adhesives and straps, other kinds of mechanical fasteners, and the like, could be employed to secure the component parts of the systems to the duct and/or surrounding structure.

While the circuits are shown with a single signal device, a combination of devices could also be used. For example, a visual or audio signal could be used in combination with a wireless transmitter so that two modes of signaling could be implemented to ensure that the condition detected by the circuit is checked.

By providing a circuit that can monitor moisture or humidity in connection with an HVAC-type duct using component parts of the duct along with electrical circuit components as a power source and signal device, a significant advantage is obtained as compared to discreet humidity sensors. By using the liner and vapor barrier electrically conductive components as part of the electrical circuit or for capacitance measurement, the component cost of the system is significantly reduced. Also, by using the entire of the length of a given piece of duct work, the monitoring of the condition of the duct, either from a humidity or moisture standpoint or a thermal resistance standpoint, is not limited to just certain locations as would be the case if discrete sensors were used in the duct. Therefore, the entire duct length can be monitored for a change of condition that would allow for remedial action and avoid potential mold growth, corrosion of the duct liner, and loss of insulating value if moisture is a problem or reduced thermal efficiency occurs if the duct configuration is compromised by compressing, kinking, de-compression and the like.

Besides the circuits described above for monitoring moisture/humidity and/or thermal resistance, the invention also entails method of monitoring the conditions of a duct, from the standpoint of moisture/humidity and/or thermal resistance, both at the time of installation and over time after the duct has been installed.

When monitoring moisture/humidity and in one mode, the duct having the electrically conductive surfaces for the liner and vapor barrier would be combined with the electrical circuit components of the leads, power source, and signal device and installed in a desired location. Once in the location, the circuit can continuously monitor the condition of the duct from a moisture/humidity standpoint. Once the circuit would be completed and the signal device would send its alert signal, the duct can be inspected for a moisture problem.

In the capacitance mode, the duct would be equipped with the capacitance measuring circuit and capacitance could be measure at selected intervals, e.g., minutes, hours, days, etc. Knowing the baseline measurement of the duct capacitance, the capacitance measuring circuit can determine a change in capacitance and send the appropriate alert for duct inspection. The capacitance monitoring for moisture/humidity problems would continue after the duct is installed as a moisture problem is more likely to occur well after the duct has been installed as the duct is not likely to be subjected to forces that would change the duct configuration after installation.

For monitoring thermal resistance, the capacitance measuring circuit is especially useful when used in conjunction with installation of the duct as measuring capacitance shortly after the duct is installed can provide an indication of some problem with the installation, wherein the duct thermal resistance would be compromised. An alert at this time allows the installer to recheck the installation for a problem. With the check of thermal resistance completed in connection with the duct installation, the capacitance measuring circuit can continue to monitor for capacitance changes at selected time intervals for either a moisture problem or some disruption with the duct installation that would cause a change in capacitance.

While the invention is described above primarily for flexible ducts generally used in HVAC systems, the invention is equally applicable to any fluid carrying conduit, which would be analogous to the duct described that has the combination of the inner liner, vapor barrier, and space therebetween. Such a fluid-carrying conduit would have an inner conduit, an outer member, and space between the inner conduit and outer member, the space allowing for one or both of capacitance measurement and completion of an electric circuit for moisture detection.

While the duct embodiment described in connection with FIGS. 1*a* and 1*b* above is highly flexible, the inner conduit and/or outer member could be made of more somewhat rigid materials, ones that would accommodate some manual bending during an installation, e.g., polymeric materials like polyethylene of raised temperature (PERT) or a cross linked polyethylene (PEX) PEX tubing. Alternatively, the fluid-carrying conduit could involve more rigid materials that would not be susceptible to manual bending at all. The wall thickness of the inner conduit and outer member could also vary as well, with thicker wall constructions being less flexible or not flexible at all. In fact, the inner conduit could virtually be made of any materials that allow for flow of the fluid in the inner conduit.

The outer member could also be made of any material that provides the space between the outer surface of the inner conduit and outer member. Each of the inner conduit and the outer member have a construction that allows for the presence of the electrically conductive surfaces for the outer surface of the inner conduit and inner surface of outer member to allow for one or both of moisture and thermal resistance monitoring, which is similar to the construction of the flexible duct of FIGS. 1*a* and 1*b*. The electrical conductivity could be established using the same techniques described above for the liner and vapor barrier, e.g., a metallized PET film adhered to the outer surface of the inner conduit and inner surface of the outer member being one example.

The space between the inner conduit and outer member could contain any type of insulating material, including the bulk insulation used in the flexible duct embodiment of the invention. Other insulating materials could be foams, both closed and open cell foams, e.g., the kind of foam insulation used in line sets for refrigerant systems. As air is also technically an insulator, the inner conduit and outer member could also be separated by just an air space and the appropriate spacer or other structure could be employed between the inner conduit and outer member or as part of either the inner conduit or outer member to maintain the space along the length of the conduit.

It should be understood that when the conduit is used for moisture detection by completion of an electrical circuit or by monitoring for a change in capacitance, the best material for use in the space between the inner conduit and outer member should be capable of completing the electric circuit by absorbing and wicking moisture from the point of entry across the space. An example of such a material other than fiberglass insulation would be mineral wool.

While the system and method for monitoring moisture detection is typically used to monitor moisture from entering the conduit or duct from the outside, leaking of fluid passing through the liner or inner conduit into the space could also be detected using the inventive system and methodology.

More particularly, the invention also has application for a fluid-carrying conduit where leakage of the material flowing through the conduit needs to be monitored. In this embodiment, the same opposing electrically conductive materials would need to be present. However, they can be provided without the need for an insulating material like fiberglass. For example, the fluid-carrying conduit could be made of a metallic material, whose outer wall would provide one of the needed electrically conductive materials. Testing has been performed using a fluid carrying conduit made of a metallic material and the results of this testing in terms of leak detection showed similar behavior as compared to a non-metallic fluid-carrying conduit that used a surrounding electrically conductive material that had openings therethrough. With the need to have an electrically conductive material as part of the outer surface of the fluid carrying conduit, it is believed that the conduit needs to be electrically conductive so that a leak through the conduit would be detected. With this, an outer member can be provided around the fluid-carrying conduit, with the outer member having with the electrically conductive material on or as part of its inner surface. That is, the entire outer member could be electrically conductive or just the inner surface thereof. In either event, the space between the inner surface of the outer member and the fluid-carrying conduit could have any absorbent material, which could be used for either the moisture detection mode of the invention using an electrical circuit or the capacitance measurement mode of the invention. The absorbent material could be made part of the outer member, e.g., in the form of a sleeve, and be able to be placed around the fluid-carrying conduit for detection of a leak through the conduit wall, or the absorbent material could be separate from the outer member. The outer member and its electrically conductive inner surface and absorbent material would not have to provide any insulating values for the fluid-carrying conduit if the aim is only for leak detection. So, any absorbent material could be used to occupy the space and the thickness of the absorbent material in the space could be minimal as insulation is not required; just enough material to allow for the creation of an electrical circuit or capacitance measurement upon leak occurrence. Examples of absorbent materials include natural materials, like cotton, hemp or bamboo, or synthetic materials like microfibers, or combinations thereof.

In yet another alternative, the space used for leak detection could be just an air gap that is formed by spacers or other mechanical means to create a gap between an inner surface of the outer member and the outer surface of the fluid-carrying conduit. Once a leak occurs, the condition would be detected by the change in capacitance measured by the inner surface of the outer member and the fluid-carrying electrically conductive conduit.

Figure 7:
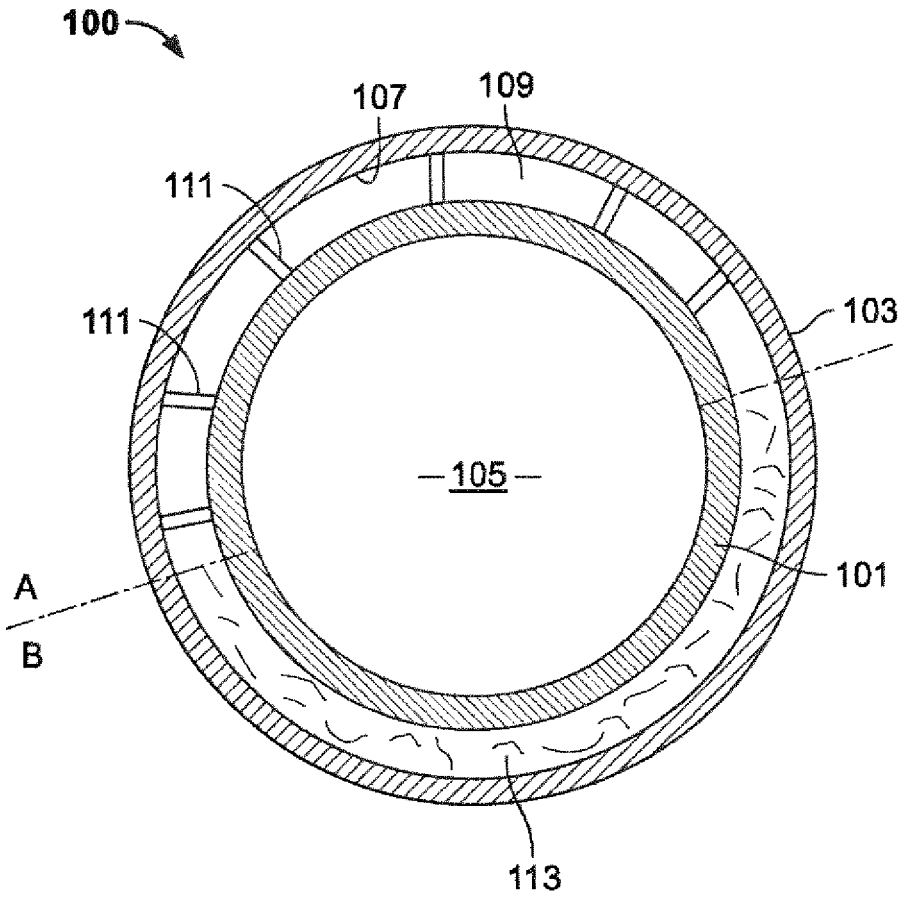
FIG. 7 shows a schematic assembly of a fluid carrying conduit, outer member and space for leak detection of fluid in the fluid carrying conduit.

FIG. 7 shows a cross sectional arrangement of two embodiments of the invention wherein leak detection could be monitored. This arrangement is designated by the reference numeral 100 and includes a fluid-carrying conduit 101 and an outer member 103. The fluid-carrying conduit carries a fluid 105. The fluid-carrying conduit is an electrically conductive material so that it can function as part of a leak detection system. The outer member 103 is shown as a non-metallic material and includes an electrically conductive film 107 adhered to the outer member 103. A space 109 is formed between the outer member 103 and fluid-carrying conduit 101. The "A" half of FIG. 7 represents an embodiment wherein air and spacers 111 are used. The "B" half of FIG. 7 represents an embodiment wherein the space includes an absorbent media 113. Using the moisture detection system of the invention wherein an electrical circuit is employed and embodiment "B", the system can be monitored for a leak through the wall of the fluid-carrying conduit, wherein the absorbent media would ultimately complete the electric circuit and produce an alert about a leak in the fluid-carrying conduit. Using either embodiments "A" or "B" and the capacitance measurement feature of the invention, a leak through the fluid-carrying conduit can be detected by a change in capacitance as measured across the air gap 109 or absorbent media 113.

In yet another aspect of the invention, if the spacers 111 were absorbent, this configuration could also be used for moisture detection using the electrical circuit embodiment of the invention. That is, the absorbent spacers, when wet, would provide the necessary electrically conductive path for the circuit to be completed and allow for moisture detection.

While FIG. 7 was directed to a leak detection system, an improved leak detection is disclosed herein. As disclosed for the FIG. 7 embodiment, the inner conduit would be made of a non-conductive material, e.g., polymeric materials like polyethylene of raised temperature (PERT) or a cross linked polyethylene (PEX) PEX tubing, polyvinyl chloride and the like. These are only examples of typical conduit materials that would need leak detection and any non-conductive conduit or pipe that is in need of being monitored for leak detection can be used in this embodiment of the invention.

Another aspect of this embodiment is that the electrically conductive material that is associated with the inner conduit has a number of openings that make it porous in nature so that moisture, i.e., fluid being carried by the inner conduit, which would pass through the inner conduit as a result of a failure in the integrity of the inner conduit would also then be able to pass through the electrically conductive material that surrounds the inner conduit and enter the space that is between the inner conduit and the outer member.

The same capacitance sensing circuit described above for detecting moisture in the space that could come through the vapor barrier, connections between conduits, or other ways, would be used to detect a leak of fluid being carried by the inner conduit, the fluid passing through the inner conduit and through one or more of the openings in the electrically conductive material for detection using the capacitance sensing circuit. Likewise, the embodiment described above using an electrical circuit is also believed to be applicable for leak detection.

The porous nature of the opening-containing electrically conductive material is such that it would maintain its ability to function in a capacitance sensing way but still allow any fluid that would leak through the inner conduit to be detected. Examples of leaks in the inner conduit could be cracks that occur over time in the inner conduit.

Examples of the kinds of openings that to allow leaking fluid to pass through the electrically conductive layer around the inner conduit would be perforations extending through the electrically conductive material surrounding the inner conduit, the perforations spaced apart from adjacent perforations both axially and circumferentially with respect to the inner conduit so that the outer surface of inner conduit is substantially covered with perforations. With this distribution of perforations, a leak anywhere along the length or circumference of the inner conduit would cause fluid to flow through the perforations and into the space for detection by the capacitance sensing circuit. While the previous embodiments were designed to detect "moisture" in the space, the same moisture detection is achieved using this embodiment, albeit that the amount of moisture may be significantly more if an inner conduit was carrying water, for example, and the inner conduit developed a crack that allowed water through the perforations and into the space between the electrically conductive materials.

The openings in the electrically conductive material associated with the inner conduit can be any shape, including circles, squares, rectangles. One example of openings would be generally circular openings that would have a diameter ranging from about 1/16 inch to about an inch, with a more preferred range being between about 1/8 inch and about 1/2 inch. Each opening would be spaced from adjacent openings in a range of about 1/2 inch to about 2 inches, with a more preferred spacing between about 3/4 inch to about 1.5 inches. A preferred arrangement would be to have 1/8 inch openings, which are spaced apart about an inch.

In terms of a percentage of the area of the electrically conductive material surrounding the inner conduit, the openings in the electrically conductive material could be arranged in terms of an area of openings compared to a total area of the electrically conductive material. It is believed that if an area of the openings is at least 5% of the area of the electrically conductive material, this amount of open area would be sufficient to let moisture or fluid from a leaking inner conduit pass through the openings of the electrically conductive material for detection using the capacitance sensing circuit. It is believed that an open area of 50% to even 70% would still allow the capacitance sensing circuit to function to detect any leaks in the inner conduit. In fact, the upper limit of the open area would be that where the electrically conductive material surrounding the non-conductive inner conduit would have so little area that the capacitance sensing circuit would not be able to function for moisture/water detection. In instances where the electrically conductive material would be more three-dimensional, e.g., a mesh or the like, the porosity of such material is believed to be analogous to the area ranges noted above if a two-dimensional electrically conductive material is used, e.g., a metallized film.

Even with a limited number of openings and wherein the electrically conductive material is a film that surrounds the inner conduit so that there can be one or more gaps between the film and the outer surface of the inner conduit, it is believed that any fluid from the inner conduit that leaks therefrom would migrate between the outer surface of the inner conduit and the inner surface of the electrically conductive material until such fluid would reach an opening and pass through it so that the capacitance sensing circuit could function to detect such fluid and the desired action could be taken.

While the leak detection embodiment can function when an air gap exists between the two electrically conductive materials that form part of the capacitance sensing circuit, it is preferred to have at least some amount of material in the gap between the two electrically conductive materials to facilitate the capacitance measuring capability of the circuit. In some instance, where if the inner conduit needs to be insulated, the material could be an insulating material like bulk fiberglass insulation. In other instances, the material could be just a material that could absorb fluid from a leaking inner conduit and allow the capacitance sensing circuit to function, e.g., an absorbent felt or the like.

Further yet, the material positioned between the two electrically conductive materials can take up less than the entire space between the electrically conductive materials. For example, an absorbent material of defined size could be spirally wound around the electrically conductive material surrounding the inner conduit or pipe so that gaps would exists between the spiral windings. This arrangement would still provide the presence of an absorbent material to hold any fluid leaking from the inner conduit or pipe but allow for less material to be used and lower costs for the system.

The same kinds of electrically conductive materials described above for the capacitance sensing circuit can be utilized for the leak detection circuit, one difference being is that the electrically conductive material surrounding the inner conduit has openings to allow any fluid leaking through the inner conduit to enter the space between the electrically conductive materials.

In a preferred embodiment where an insulation is provided between the inner conduit and vapor barrier, the vapor barrier and its associated electrically conductive material remains intact and do not have any openings so as to maintain the functionality of the insulation around the inner conduit. In other embodiments though, where insulation is not used and the integrity of the vapor barrier or other outer member surrounding the inner conduit against any fluid passing through the vapor barrier or other outer member is not desired, the electrically conductive material associated with the vapor barrier or other outer member could also have openings similar to those described above for the inner conduit.

While the same metallized polyester film as used in the embodiments discussed above for just moisture detection in a duct can be used in the leak detection embodiment of the invention, the electrically conductive material could have other compositions and forms as well. For example, the electrically conductive material could be in the form of a screen, a mesh, or a wool. In fact, anything that would provide the desired electrical conductivity and at the same time allow a fluid leaking through the inner conduit to pass through the electrically conductive material is a candidate for the opening-containing electrically conductive material of this leak detection embodiment of the invention.

Figure 8:
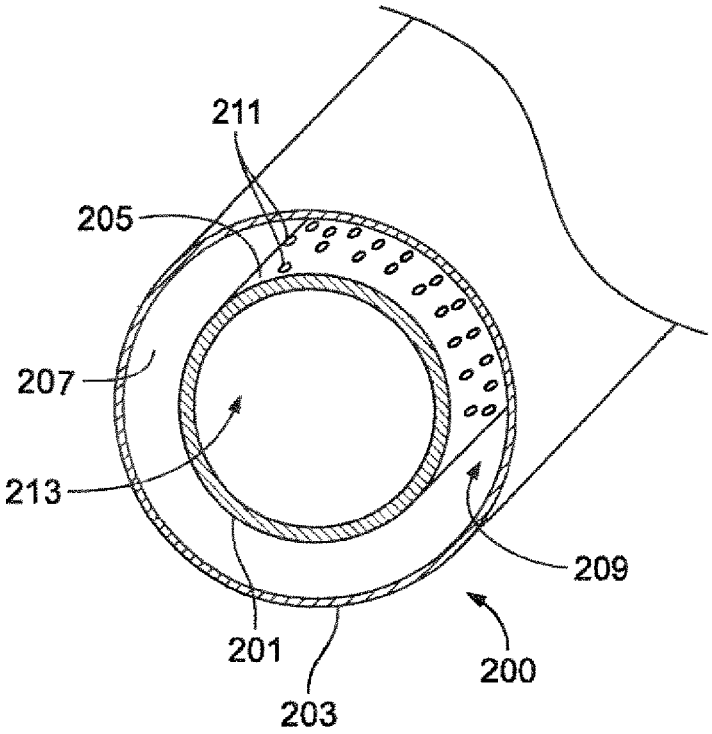
FIG. 8 shows a schematic assembly of another embodiment for leak detection of a fluid carried by a conduit.

FIG. 8 shows a cross sectional view of one embodiment of the leak detection embodiment of the invention. The inventive system is designated by the reference numeral 200. An inner conduit 201, made of a non-conductive material, is shown positioned inside an outer member 203. The inner conduit 201 has its electrically conductive material 205 surrounding its outer surface. Similarly, the outer member 203 has its electrically conductive material 207 surrounding an inner surface of the outer member 203. For ease of understanding, any absorbent or insulating material used in the space 209 between the inner conduit 201 and outer member 203 is not shown. However, as with the embodiments above, the space can have an absorbent or insulating material and can be the same types as disclosed above for the moisture detection and thermal resistance embodiments. Also not shown is any of the components of the capacitance sensing circuit for better understanding of FIG. 8.

The electrically conductive material 205 associated with the inner conduit 201 has a plurality of openings 211. Should the inner conduit 201 fail for some reason so that a fluid being carried by the space 213 of the inner conduit would pass through a wall of the inner conduit, the openings 211 would allow the fluid to enter the space 209 and this would allow the capacitance sensing circuit to sense the presence of fluid in the space 209 and the appropriate remedial action can be taken.

Figure 9A:
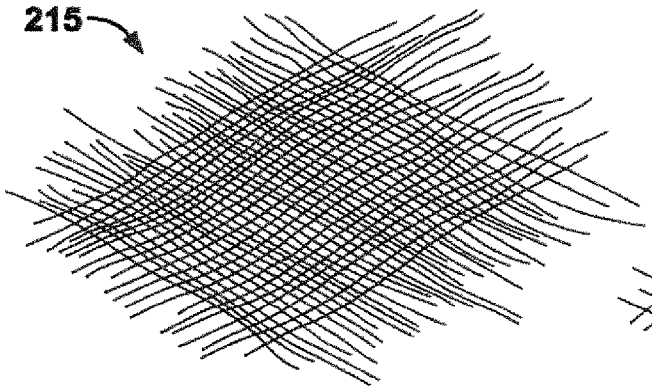
FIGS. 9A and 9B illustrate different kinds of materials for the electrically conductive material of the leak detection system of FIG. 8.
Figure 9B:
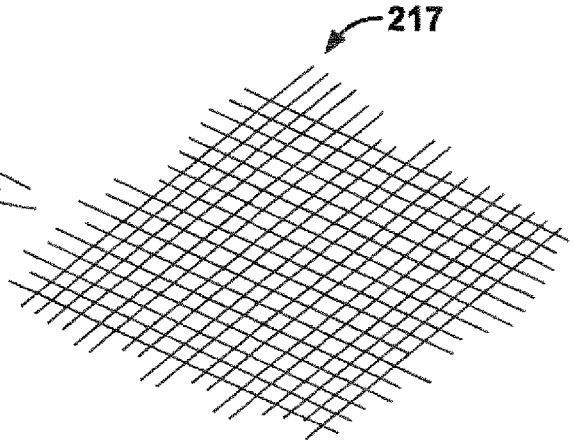
Figure 9C:
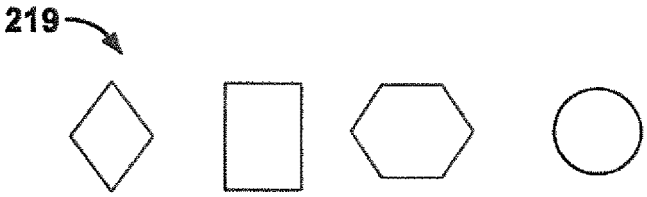
FIG. 9C shows different shaped openings for the electrically conductive material of the leak detection system of FIG. 8.

While the electrically conductive material is representative of a film-like material with openings, other opening-containing materials can be employed. FIG. 9A shows an example of a mesh material 215 and FIG. 9B shows a screen material 217. Also, while the openings are shown in FIG. 8 as being generally circular, openings could take other configurations as shown in FIG. 9C, wherein different polygonal or non-circular shapes 219 are illustrated as an opening.

While FIG. 8 does not show any material in the space 209, any absorbent material, insulating material, or air can be used to occupy the space 209. Examples of materials for use in the space include absorbent felts, fiberglass, and the like.

In terms of the capacitance sensing circuit, a dry situation is generally reflected by measurements that are below 0.01 micro-farads. However, experimental testing has shown that when small quantities of water would enter the space between the two electrically conductive materials, e.g., a teaspoon, the capacitance measurement would jump to 5.0 or more micro-farads. Thus, the capacitance sensing circuit is fully capable of determining a leak in an inner conduit. Thus, any device able to measure capacitances above 0.01 micro-farads is believed to be satisfactory for the capacitance sensing circuit, either for the leak detection embodiment, or just sensing moisture in a duct or a change in configuration of a duct, that may affect thermal resistance or be an indicator of an improper installation of the duct.

In other experimental testing conducted in connection with the leak detection embodiment disclosed herein, two test assemblies were made to test the effect of the reducing the area of the electrically conductive material by forming openings therein. In one assembly, a thin absorbent felt was positioned between two flat conductive films, and neither film had any openings therethrough. In the second assembly, the same configuration of film and felt was used, but one of the conductive films had a plurality of openings therethrough. For the second assembly, approximately 50% of the electrically conductive material was removed when openings were made in the material. Although this resulted in a 40% drop in the initial capacitance, both perforated and non-perforated material had capacitances measuring in Picofarads under dry conditions. Upon introduction of a liquid between the two electrically conductive materials, i.e., the thin felt was saturated, both the non-perforated and perforated materials exhibited capacitance measurements in the micro-farads, which was an increase by a factor of one million. Thus, the change in an initial capacitance due to a reduction in the area of the electrically conductive material is insignificant relative to the capacitance change resulting from the change in the dielectric due to wetting. Because of these factors and the fact that a change in the initial baseline capacitance measure is being monitored, the only limitation in material removal (number/size of openings in the electrically conductive material) is the ability to establish a constant and measurable initial value and preserve the physical characteristics of the electrically conductive material so as to allow for reasonable application of the material.

Another way to look at the effect of changing the area of one of the electrically conductive materials is from a permittivity standpoint. The change from liquid displacing air is approximately a factor of 80 (permittivity of air is 1/permittivity of water is 80). Capacitance varies directly with permittivity and area. So, in theory, the conductor area would have to decrease by the same factor to mask the increase of the permittivity change for a given duct/pipe. However, and as mentioned above, the edge effects of the electrical fields around the film perforations tends to reduce the impact of lost area. Thus, the area of the electrically conductive material can be significantly reduced and the capacitor would still function well in a given application. The actual lower limit of area for the electrically conductive material would be one that provides a measurable and consistent capacitance for both dry and conduit leaking conditions. The initial (dry) measurement would then be driven up by presence of liquid.

The assemblies tested were not in a configuration of a duct but rather a flat configuration. However, it is believed that a duct assembly made of an inner conduit, outer member, and insulation therebetween, wherein the inner conduit has an openings-containing electrically conductive material on its outer surface and the outer member had an electrically conductive material on its inner surface, would perform similarly to the test assemblies as the components used for capacitance measurement are the same.

It is also believed that while forming openings in the electrically conductive material does reduce area and would reduce capacitance, fringe electrical fields around the openings increase fringe capacitance and this is believed to offset any adverse effects by a reduction in the area of the plate, i.e., electrically conductive material.

As such, an invention has been disclosed in terms of preferred embodiments thereof which fulfills each and every one of the objects of the present invention as set forth above and provides a new and improved devices and methods to monitor a conduit or problems caused by humidity/moisture and changes in thermal resistance.

Of course, various changes, modifications and alterations from the teachings of the present invention may be contemplated by those skilled in the art without departing from the intended spirit and scope thereof. It is intended that the present invention only be limited by the terms of the appended claims.

We claim:

1. A system for monitoring moisture and/or thermal resistance in a fluid-carrying duct comprising:

the fluid-carrying duct having an inner duct, an outer member, and a space between the inner duct and the outer member, the space containing an absorbent media or air, the inner duct having an electrically conductive material on or as part of an outer surface of the inner duct and the outer member having an electrically conductive material on or as part of an inner surface of the outer member, and one of:

a means for monitoring moisture in the space between the inner duct and the outer member of the fluid-carrying duct by using the electrically conductive outer surface of the inner duct and the electrically conductive inner surface of the outer member and the space between the electrically conductive materials of the inner duct and outer member; and a means for monitoring thermal resistance of the fluid-carrying duct by using the electrically conductive outer surface of the inner duct and the electrically conductive inner surface of the outer member and the space between the electrically conductive materials of the inner duct and outer member.

2. The system of claim 1, wherein the absorbent media is a bulk insulation.

3. The system of claim 1, further comprising a pair of electrodes, a first electrode attached to the outer surface of the inner duct and a first end of the wiring and a second electrode attached to the inner surface of the outer member and a second end of the wiring.

4. The system of claim 1, wherein the fluid-carrying duct is flexible or rigid.

5. A system for monitoring moisture in a fluid-carrying conduit comprising:

the fluid-carrying conduit having an inner conduit, an outer member, and a space between the inner conduit and the outer member, the space containing an absorbent media or air, the inner conduit having an electrically conductive material on or as part of an outer surface of the inner conduit and the outer member having an electrically conductive material on or as part of an inner surface of the outer member, and a means for monitoring moisture in the space between the inner conduit and the outer member of the fluid-carrying conduit by using the electrically conductive outer surface of the inner conduit and the electrically conductive inner surface of the outer member and the space between the electrically conductive materials of the inner conduit and outer member, wherein the means for monitoring moisture further comprises:

a capacitance sensing circuit comprising a power source, a capacitance measuring device, a signal device, and wiring, a first end of the wiring of the circuit connected to the electrically conductive material of the inner conduit and a second end of the wiring connected to the electrically conductive material of the outer member, the capacitance measuring device and the signal device located in the circuit between the first end and second end of the circuit, wherein when the capacitance measuring device detects a change in capacitance from an initial capacitance for the fluid-carrying conduit, the signal device is powered to provide an indication of a change in capacitance in the space between the electrically conductive materials of the fluid-carrying conduit.

6. The system of claim 5, wherein the signal device comprises one or more of a light, an audible alarm, or a transmitter to send a wireless signal.

7. The system of claim 5, wherein the electrically conductive material can be a film, a foil, or a laminate adhered to the outer surface of the inner conduit and/or the inner surface of the outer member.

8. The system of claim 7, wherein the film is a metallized polyester film.

9. The system of claim 8, wherein the metallized polyester film can be adhered using an adhesive between the electrically conductive material and the outer surface of the inner conduit and/or the inner surface of the outer member.

10. The system of claim 9, wherein the first electrode comprises a first electrically conductive material adhered to the outer surface of the inner conduit and a first metal connector adhered to the electrically conductive material and configured to snap connect to the first end of the wiring, and wherein the second electrode comprises a second electrically conductive material adhered to the inner surface of the outer member and a second metal connector adhered to the electrically conductive material and configured to snap connect to the second end of the wiring.

11. The system of claim 10, wherein a conductive epoxy is used as the first and second electrically conductive material of the electrodes.

12. The system of claim 5, further comprising means for connecting the capacitance measuring device, the power source, and the signal device of the capacitance measuring circuit or the power source and signal device of the moisture detection circuit to both the fluid-carrying conduit and structure attached to an end of the fluid-carrying conduit.

13. A duct system for detecting moisture in insulation-containing ductwork comprising:

a duct having a liner, a layer of bulk insulation, and a vapor barrier, the layer of insulation positioned between the liner and the vapor barrier, the liner having an electrically conductive material on or as part of an outer surface of the liner and the vapor barrier having an electrically conductive material on or as part of an inner surface of the vapor barrier and a means for monitoring moisture in the space between the liner and the vapor barrier of the duct by using the electrically conductive outer surface of the liner and the electrically conductive inner surface of the vapor barrier.

14. The duct system of claim 13, wherein the means for monitoring further comprises a capacitance sensing circuit comprising a power source, a capacitance measuring device, a signal device, and wiring, a first end of the wiring of the circuit connected to the electrically conductive material of the liner and a second end of the wiring connected to the electrically conductive material of the vapor barrier, the capacitance measuring device and the signal device located in the circuit between the first end and second end of the circuit, wherein when the capacitance measuring device detects a change in capacitance from an initial capacitance for the duct, the signal device is powered to provide an indication of a change in capacitance in the space between the electrically conductive materials of the duct.

15. The duct system of claim 14, wherein the signal device comprises one or more of a light, an audible alarm, or a transmitter to send a wireless signal.

16. The duct system of claim 14, wherein the electrically conductive material can be a film, a foil, or a laminate adhered to the outer surface of the liner and/or the inner surface of the vapor barrier.

17. The duct system of claim 16, wherein the film is a metallized polyester film.

18. The duct system of claim 17, wherein the metallized polyester film can be adhered using an adhesive between the electrically conductive material and the outer surface of the liner and/or the inner surface of the vapor barrier.

19. The duct system of claim 14, further comprising a pair of electrodes, a first electrode attached to the outer surface of the liner and the first end of the wiring and a second electrode attached to the inner surface of the vapor barrier and the second end of the wiring.

20. The duct system of claim 19, wherein the first electrode comprises a first electrically conductive material adhered to the outer surface of the liner and a first metal connector adhered to the electrically conductive material and configured to snap connect to the first end of the wiring, and wherein the second electrode comprises a second electrically conductive material adhered to the inner surface of the vapor barrier and a second metal connector adhered to the electrically conductive material and configured to snap connect to the second end of the wiring.

21. The duct system of claim 19, wherein a conductive epoxy is used as the first and second electrically conductive material of the electrodes.

22. A system for monitoring moisture and/or thermal resistance in a fluid-carrying conduit comprising:

the fluid-carrying conduit having an inner conduit, an outer member, and a space between the inner conduit and the outer member, the space containing an absorbent media or air, the inner conduit having an electrically conductive material on or as part of an outer surface of the inner conduit and the outer member having an electrically conductive material on or as part of an inner surface of the outer member, and a means for monitoring moisture in the space between the inner conduit and the outer member of the fluid-carrying conduit by using the electrically conductive outer surface of the inner conduit and the electrically conductive inner surface of the outer member and the space between the electrically conductive materials of the inner conduit and outer member, wherein the inner conduit is made of a non-conductive material, the electrically conductive material that is on or is a part of the outer surface of the inner conduit has a plurality of openings therethrough, the system includes the means for monitoring moisture in the space between the inner conduit and the outer member of the fluid-carrying conduit by using the electrically conductive outer surface of the inner conduit and the electrically conductive inner surface of the outer member and the space between the electrically conductive materials of the inner conduit and outer member, wherein the openings permit fluid leaking through the inner conduit to be detected using the means for monitoring moisture in the space.

23. The system of claim 22, wherein the means for monitoring moisture in the space is a capacitance sensing circuit comprising a power source, a capacitance measuring device, a signal device, and wiring, a first end of the wiring of the circuit connected to the electrically conductive material of the inner conduit and a second end of the wiring connected to the electrically conductive material of the outer member, the capacitance measuring device and the signal device located in the circuit between the first end and second end of the circuit, wherein when the capacitance measuring device detects a change in capacitance from an initial capacitance for the fluid-carrying conduit, the signal device is powered to provide an indication of a change in capacitance in the space between the electrically conductive materials of the fluid-carrying conduit.

24. The system of claim 22, wherein the electrically conductive material of the inner conduit is a metallized polyester film.

25. The system of claim 22, wherein the plurality of openings are at least 5% of a total area of an outer surface of the electrically conductive material of the inner conduit.

26. The system of claim 22, wherein the plurality of openings are generally circular and range from about 1/16 inch to 1 inch in diameter and a spacing between adjacent openings ranges between ½ to 2 inches.

27. A system for monitoring thermal resistance in a fluid-carrying conduit comprising:

the fluid-carrying conduit having an inner conduit, an outer member, and a space between the inner conduit and the outer member, the space containing an absorbent media or air, the inner conduit having an electrically conductive material on or as part of an outer surface of the inner conduit and the outer member having an electrically conductive material on or as part of an inner surface of the outer member, and a means for monitoring thermal resistance of the fluid-carrying conduit by using the electrically conductive outer surface of the inner conduit and the electrically conductive inner surface of the outer member and the space between the electrically conductive materials of the inner conduit and outer member, wherein the means for monitoring thermal resistance further comprises:

a capacitance sensing circuit comprising a power source, a capacitance measuring device, a signal device, and wiring, a first end of the wiring of the circuit connected to the electrically conductive material of the inner conduit and a second end of the wiring connected to the electrically conductive material of the outer member, the capacitance measuring device and signal device located in the circuit between the first end and second end of the circuit, wherein when the capacitance measuring device detects a change in capacitance from an initial capacitance for the fluid-carrying conduit, the signal device is powered to provide an indication of a change in capacitance in the space between the electrically conductive materials of the fluid-carrying conduit.

28. The system of claim 27, wherein the signal device comprises one or more of a light, an audible alarm, or a transmitter to send a wireless signal.

29. The system of claim 27, wherein the electrically conductive material can be a film, a foil, or a laminate adhered to the outer surface of the inner conduit and/or the inner surface of the outer member.

30. The system of claim 29, wherein the film is a metallized polyester film.

31. The system of claim 30, wherein the metallized polyester film can be adhered using an adhesive between the electrically conductive material and the outer surface of the inner conduit and/or the inner surface of the outer member.

32. The system of claim 27, further comprising a pair of electrodes, a first electrode attached to the outer surface of the inner conduit and a first end of the wiring and a second electrode attached to the inner surface of the outer member and a second end of the wiring.

33. The system of claim 32, wherein the first electrode comprises a first electrically conductive material adhered to the outer surface of the inner conduit and a first metal connector adhered to the electrically conductive material and configured to snap connect to the first end of the wiring, and wherein the second electrode comprises a second electrically conductive material adhered to the inner surface of the outer member and a second metal connector adhered to the electrically conductive material and configured to snap connect to the second end of the wiring.

34. The system of claim 33, wherein a conductive epoxy is used as the first and second electrically conductive material of the electrodes.

35. The system of claim 27, wherein the fluid-carrying conduit is flexible or rigid.

* * * * *